US011536522B2

(12) United States Patent
Puha

(10) Patent No.: US 11,536,522 B2
(45) Date of Patent: Dec. 27, 2022

(54) GAS-DELAYED BLOWBACK OPERATING SYSTEM AND METHOD FOR AR-PATTERN FIREARMS

(71) Applicant: Eight Holdings LLC, Coeur D-Alene, ID (US)

(72) Inventor: Teodor Puha, Coeur D-Alene, ID (US)

(73) Assignee: EIGHT HOLDINGS LLC, Coeur D'Alene, ID (US)

( * ) Notice: Subject to any disclaimer, the term of this patent is extended or adjusted under 35 U.S.C. 154(b) by 0 days.

(21) Appl. No.: 17/462,464

(22) Filed: Aug. 31, 2021

(65) Prior Publication Data

US 2022/0099392 A1 Mar. 31, 2022

Related U.S. Application Data

(60) Provisional application No. 63/074,634, filed on Sep. 4, 2020.

(51) Int. Cl.

| | |
|---|---|
| ***F41A 3/62*** | (2006.01) |
| ***F41C 23/06*** | (2006.01) |
| ***F41A 3/54*** | (2006.01) |

(52) U.S. Cl.

CPC ..... *F41A 3/62* (2013.01); *F41A 3/54* (2013.01); *F41C 23/06* (2013.01)

(58) Field of Classification Search

CPC ..... F41A 3/54; F41A 3/62; F41C 23/06
USPC ..... 89/183
See application file for complete search history.

(56) References Cited

U.S. PATENT DOCUMENTS

| | | | | |
|---|---|---|---|---|
| 2,865,256 | A * | 12/1958 | Marsh | F41A 3/62 89/191.01 |
| 3,990,346 | A * | 11/1976 | Irwin | F41A 3/62 89/191.01 |
| 5,388,500 | A * | 2/1995 | Petrovich | F41A 3/62 89/129.01 |
| 8,181,563 | B1 * | 5/2012 | Peterken | F41A 11/02 89/191.01 |
| 2002/0096042 | A1 * | 7/2002 | Adkins | F41A 3/62 89/194 |
| 2019/0383572 | A1 * | 12/2019 | Gregorich | F41A 15/14 |

* cited by examiner

*Primary Examiner* — Bret Hayes
(74) *Attorney, Agent, or Firm* — Eric B. Fugett; Mark A. Pitchford; Pitchford Fugett, PLLC

(57) ABSTRACT

A gas-delayed blowback firearm includes a lower receiver and an upper receiver releasably coupled thereto. A barrel having a cartridge chamber, an axial bore, and a barrel gas port is secured to the upper receiver. A bolt assembly in the upper receiver reciprocates between a forward in-battery position and a rearward position. A timing block is secured to the bolt assembly. A cylinder housing with an internal gas chamber and a cylinder gas port is secured to the upper receiver. A gas passageway fluidly communicates the barrel gas port with the cylinder gas port. A plunger in the gas chamber is secured to the timing block. The plunger reciprocates with the bolt assembly. Discharge of a cartridge received in the cartridge chamber temporarily pressurizes the gas chamber, applying a forward force to the plunger which causes the plunger to delay rearward travel of the bolt assembly.

19 Claims, 12 Drawing Sheets

GAS-DELAYED BLOWBACK OPERATING SYSTEM AND METHOD FOR AR-PATTERN FIREARMS

CROSS-REFERENCES TO RELATED APPLICATIONS

This non-provisional patent application claims priority to U.S. Provisional Patent Application Ser. No. 63/074,634, filed Sep. 4, 2020 and titled "GAS-DELAYED BLOWBACK OPERATING SYSTEM FOR AR-PATTERN FIREARMS," the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to operating systems for firearms. More specifically, the present invention relates to gas-delayed blowback operating systems for firearms.

Blowback is a well-known system of operation used in various self-loading firearms. Generally, blowback systems obtain energy to cycle the firearm from the motion of the cartridge case as it is pushed rearwardly by expanding gas created upon ignition of the propellant charge contained in the cartridge during discharge.

In simple blowback systems, the bolt assembly typically rests against the breech (i.e., the rear of the barrel) but is not locked in place. Upon ignition of the propellant, expanding gases push the projectile forward through the bore of the barrel while at the same time pushing the cartridge case rearward against the bolt. The cartridge case in turn pushes the bolt assembly rearward, which compresses the recoil spring and ejects the spent cartridge case. The recoil spring subsequently decompresses, driving the bolt assembly forward again, stripping the next cartridge from the magazine, and pushing the new cartridge into the chamber as the bolt assembly returns to its forward in-battery position.

Gas-delayed blowback systems differ from simple blowback systems in that gas-delayed systems vent propellant gases from the barrel into a cylinder with a piston that delays the opening of the bolt or slide in order to allow the projectile to exit the barrel before the cartridge case clears the chamber. This reduces operating pressures and requires fewer moving parts to cycle the firearm, which in turn results in appreciable savings in both weight and manufacturing costs, and makes the firearm more reliable and easier to service.

Nonetheless, gas-delayed blowback systems have only ever been successfully implemented in relatively low-pressure, small caliber handguns (i.e., pistols chambered in 9 mm or smaller calibers). This is because such handguns are typically simpler and lighter in design compared to most modern long guns and because higher-powered cartridges generate significantly higher pressures which require larger, heavier bolts to prevent the breech from opening prematurely upon discharge. Such relatively heavier bolt assemblies have historically proven too heavy to be reliably moved rearward solely by the expanding propellant gasses pushing the cartridge case into the bolt face. This failure to consistently move the bolt assembly rearward results in unreliable cycling of the action, and thus an unreliable and potentially unsafe firearm. Consequently, gas-delayed blowback systems are not found in modern long guns.

The WALTHER® CCP semi-automatic pistol is one of the very few modern firearms in production today which employs a gas-delayed blowback system. This pistol uses a fixed barrel and a gas chamber built into the frame below the barrel. A piston is secured at its forward end to the forward end of the slide. When a cartridge is discharged, expanding gas enters the cylinder below the barrel and delays the rearward motion of the piston, and thus the slide to which the piston is secured, so that the projectile can exit the barrel before the cartridge case can exit the chamber. However, this system is clearly unsuitable for and would not function with firearms which lack a reciprocating slide.

AR-pattern (i.e., AR-style) firearms, including the AR-15® and AR-100, the construction and operation of which are well-known, are the most popular and widely owned firearms currently in use in the United States. These firearms are famous for their reliability, modularity, and ease of use, and have been chambered to function with a wide variety of ammunition, ranging from .17 to .500 caliber cartridges, as well as 12 gauge, 20 gauge, and .410 bore shotshell cartridges. AR-pattern firearms do not include a reciprocating slide and typically employ either a direct impingement or gas piston operating system (both of which are well-known) to cycle the bolt assembly. Both operating systems use a rotating bolt that locks into a barrel extension behind the cartridge case head when a cartridge is chambered. The bolt head includes a plurality of radially extending locking lugs that are complimentary in number to a plurality of protrusions formed in the barrel extension. Once the bolt has pushed a cartridge into the chamber, the bolt rotates to cause the locking lugs to engage the protrusions on the barrel extension and thus firmly lock the bolt in place behind the case head. This enables the bolt to withstand the pressure generated upon discharge of the cartridge and prevent propellant gases from being expelled out of the receiver toward the shooter. When the cartridge is fired, the bolt rotates in the opposite direction and retracts to extract and eject the spent casing before chambering a new round. No AR-pattern firearm with a gas-delayed blowback system is known to have ever been developed.

Accordingly, what is needed are improvements in firearms and operating systems for firearms.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

It is an object of the present invention to provide a gas-delayed operating system for AR-pattern firearms, as well as a gas-delayed blowback AR-pattern firearm, which eliminates the need of traditional AR-pattern firearms for a rotating bolt with locking lugs, requires fewer parts to cycle the firearm, and simplifies firearm operation and maintenance while simultaneously preventing premature extraction of the cartridge until gas pressure in the system has dropped to safe levels.

One aspect of the present invention provides a gas-delayed blowback firearm, comprising a lower receiver; an upper receiver releasably coupled to the lower receiver; a barrel secured to the upper receiver, the barrel having a cartridge chamber, an axial bore, and a barrel gas port in fluid communication with the bore; a bolt assembly configured to reciprocate in the upper receiver between a forward in-battery position and a rearward position; a timing block on the bolt assembly; a cylinder housing secured to the upper receiver, the cylinder housing having an internal gas chamber and a cylinder gas port in fluid communication with the gas chamber; a gas passageway fluidly communicating the barrel gas port with the cylinder gas port; and a plunger in the gas chamber secured to the timing block such that the plunger reciprocates with the bolt assembly; wherein discharge of a cartridge received in the cartridge chamber temporarily pressurizes the gas chamber, applying a forward force to the plunger which causes the plunger to delay rearward travel of the bolt assembly.

In another aspect, the invention provides a gas-delayed blowback firearm, comprising an AR-pattern lower receiver; an upper receiver releasably couplable to the lower receiver; a barrel attachable to the upper receiver, the barrel having a cartridge chamber, an axial bore, and a barrel gas port in fluid communication with the bore; a bolt assembly receivable in the upper receiver and configured to reciprocate therein between a forward in-battery position and a rearward position; a timing block attachable to the bolt assembly; a cylinder housing attachable to the upper receiver, the cylinder housing having an internal gas chamber and a cylinder gas port in fluid communication with the gas chamber a recess defined in a forward portion of the upper receiver, the recess configured to receive at least a portion of the cylinder housing when the cylinder housing is attached to the upper receiver; a gas passageway defined through the upper receiver which fluidly communicates the barrel gas port with the cylinder gas port when the barrel and the cylinder housing are attached to the upper receiver; and a plunger receivable in the gas chamber and attachable to the timing block such that the plunger reciprocates with the bolt assembly when the plunger is attached to the timing block and the timing block is attached to the bolt assembly; wherein discharge of a cartridge received in the cartridge chamber temporarily pressurizes the gas chamber, applying a forward force to the plunger which causes the plunger to delay rearward travel of the bolt assembly until the pressure in the gas chamber decreases enough for a rearward force applied by the cartridge against the bolt assembly to overcome the forward force applied to the plunger and move the bolt assembly toward the rearward position.

In yet another aspect, the invention provides an upper receiver assembly for a gas-delayed blowback firearm, comprising an upper receiver releasably couplable to an AR-pattern lower receiver; a barrel attachable to the upper receiver, the barrel having a cartridge chamber, an axial bore, and a barrel gas port in fluid communication with the bore; a bolt assembly receivable in the upper receiver and configured to reciprocate therein between a forward in-battery position and a rearward position; a timing block attachable to the bolt assembly; a cylinder housing attachable to the upper receiver, the cylinder housing having an internal gas chamber and a cylinder gas port in fluid communication with the gas chamber; a recess defined in a forward portion of the upper receiver, the recess configured to receive at least a portion of the cylinder housing when the cylinder housing is attached to the upper receiver; a gas passageway defined through the upper receiver which fluidly communicates the barrel gas port with the cylinder gas port when the barrel and the cylinder housing are attached to the upper receiver; and a plunger receivable in the gas chamber and attachable to the timing block such that the plunger reciprocates with the bolt assembly when the plunger is attached to the timing block and the timing block is attached to the bolt assembly; wherein discharge of a cartridge received in the cartridge chamber temporarily pressurizes the gas chamber, applying a forward force to the plunger which causes the plunger to delay rearward travel of the bolt assembly until the pressure in the gas chamber decreases such that a rearward force applied by the cartridge against the bolt assembly overcomes the forward force applied to the plunger and moves the bolt assembly toward the rearward position.

Numerous other objects, advantages and features of the present disclosure will be readily apparent to those of skill in the art upon a review of the following drawings and description of a preferred embodiment.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the portions relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
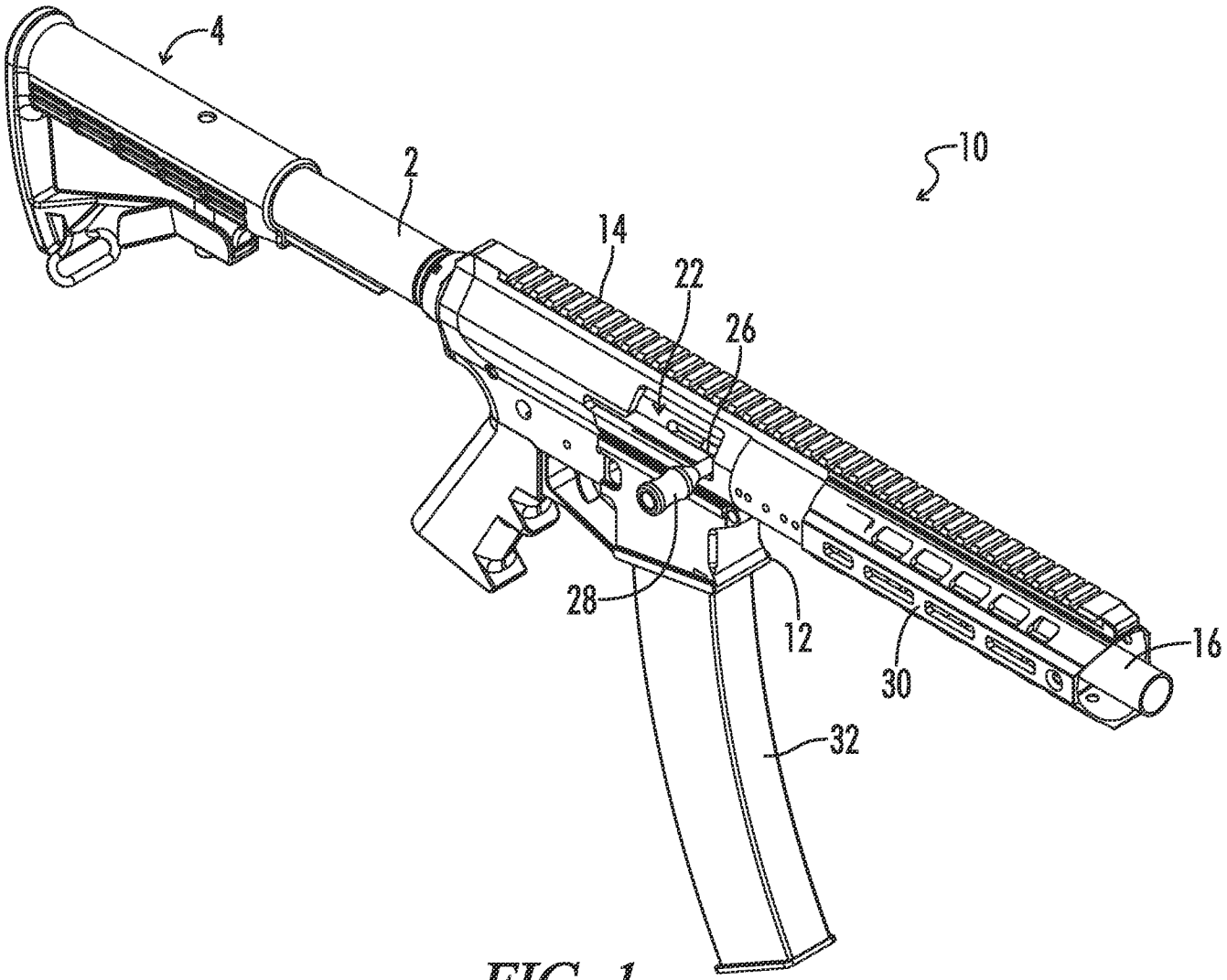
FIG. 1 is an elevated front perspective view of an embodiment of an AR-pattern firearm having a gas-delayed blowback operating system of the present invention showing the firearm in an in-battery configuration.
Figure 2:
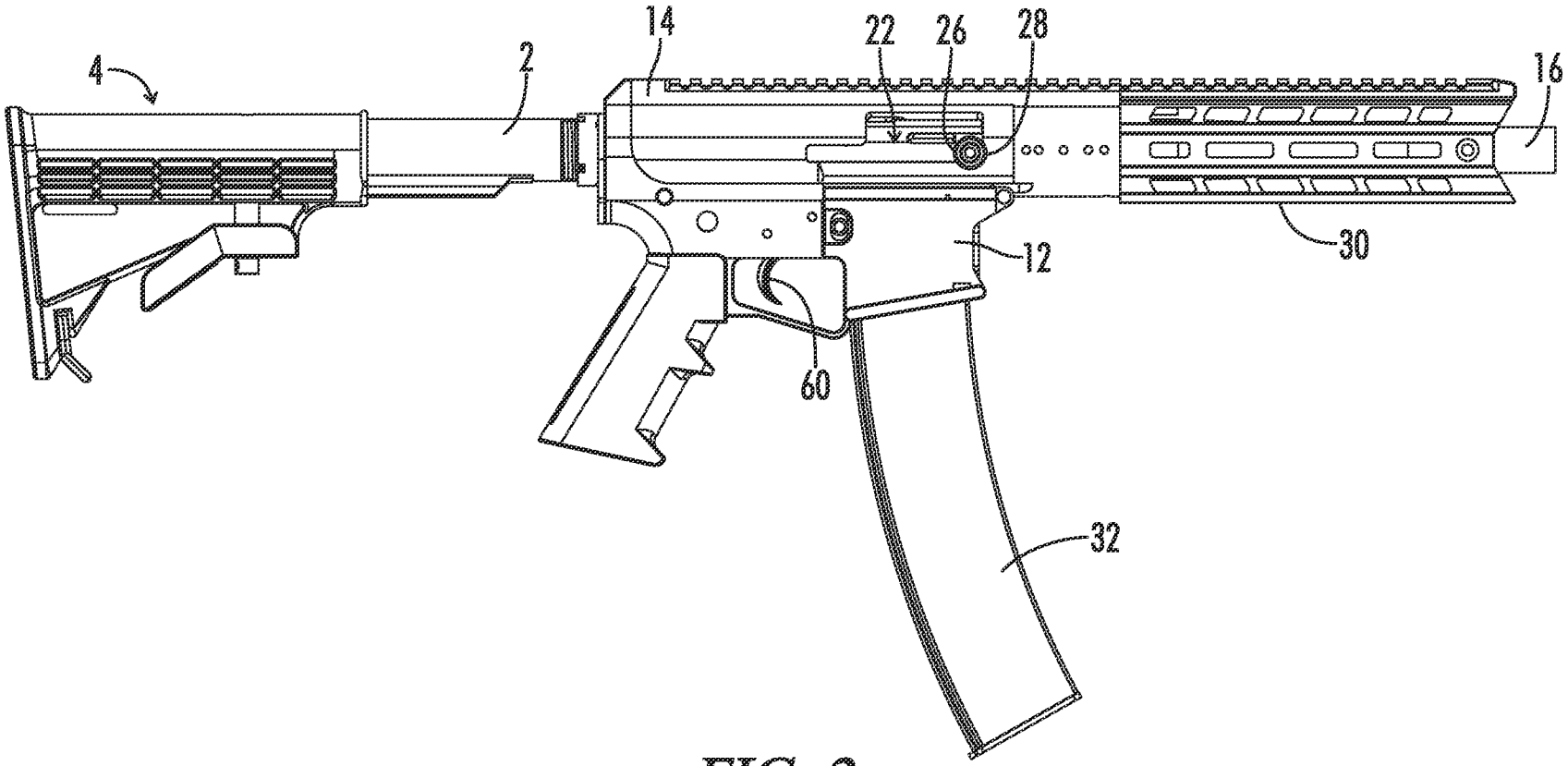
FIG. 2 is a right-side elevational view of the firearm of FIG. 1.
Figure 3:
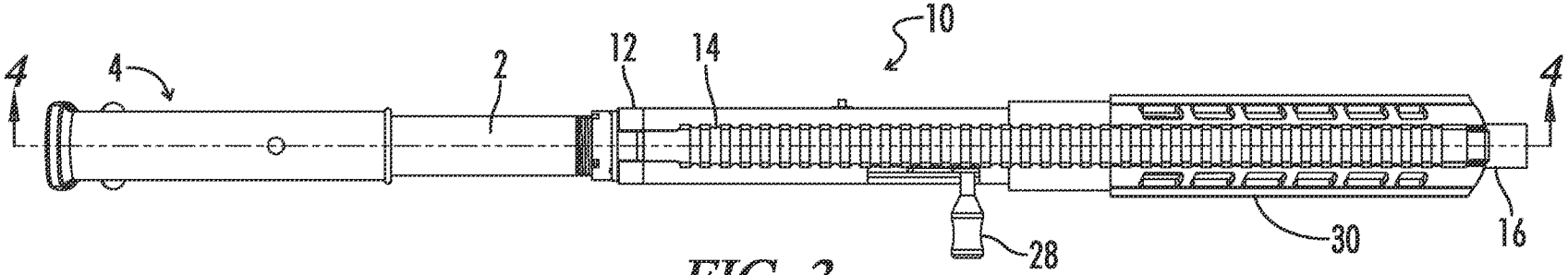
FIG. 3 is a top plan view of the firearm of FIG. 1.
Figure 4:
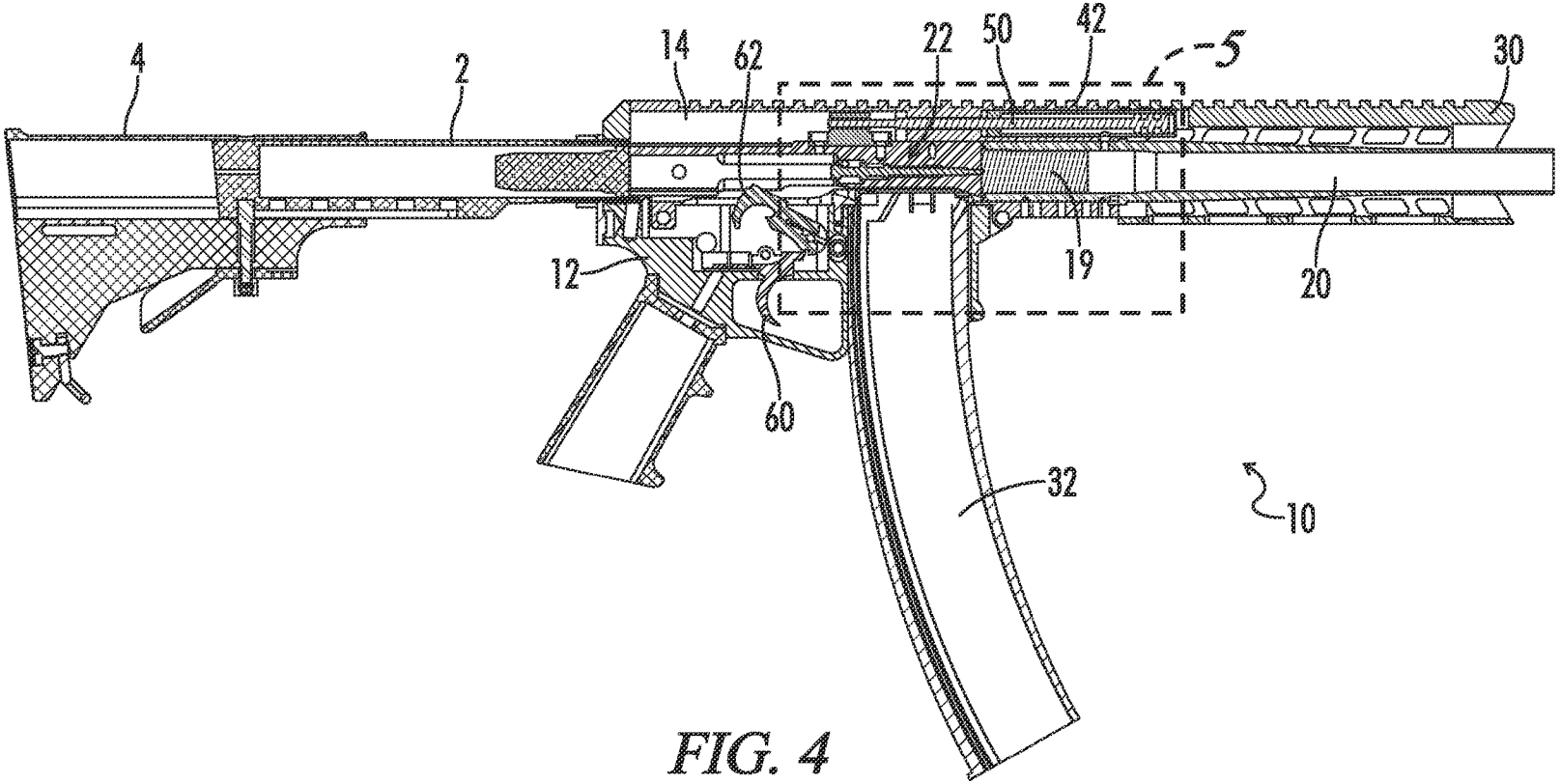
FIG. 4 is a sectional view of the firearm of FIG. 1 taken along line 4-4 of FIG. 3.

As described herein, an "upright" position is considered to be the position of apparatus components while in proper operation or in a natural resting position as described and shown herein, for example, in FIG. 2. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

As used herein, the term "forward" refers to a direction extending along a longitudinal axis of the disclosed firearm toward a muzzle of the firearm. Conversely, the term "rearward" refers to a direction extending along the longitudinal axis of the firearm away from the muzzle toward a buttstock or end of the firearm opposite the muzzle. A "rearward" direction is thus the opposite of a "forward" direction.

All measurements should be understood as being modified by the term "about" regardless of whether the word "about" precedes a given measurement.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

FIGS. 1-7 depict an embodiment of an AR-pattern firearm having a gas-delayed blowback operating system 10. A gas-delayed blowback firearm 10 includes an AR-pattern lower receiver 12 and an upper receiver 14 releasably coupled to the lower receiver 12. A receiver extension 2 is secured to the rear end of the lower receiver 12. A buttstock assembly 4 is secured to the receiver extension 2. A barrel 16 is secured to the forward portion of the upper receiver 14. The barrel 16 includes a cartridge chamber 18, an axial bore 20, and a barrel gas port 21. The cartridge chamber 18 is a short region of smooth bore sized to receive a cartridge 19, which can be a 12-gauge shotshell as shown in FIGS. 1-7, or another relatively low-pressure cartridge, including but not limited to, 9 mm, .38 caliber, .45 caliber, .40 caliber, and all shotshell gauges. The barrel gas port 21 is a hole defined through an upper portion of the barrel 16 slightly forward of and proximate to the chamber 18. The barrel gas port 21 is in fluid communication with the bore 20.

A bolt assembly 22 is received in a bolt cavity 38 of the upper receiver 14. The bolt assembly 22 reciprocates forward and rearward in the bolt cavity 38 along a longitudinal axis 17 of the upper receiver 14 to load cartridges 19 into the chamber 18 of the barrel 16 and eject spent cartridge casings after discharge. As such, the bolt assembly 22 reciprocates between a forward in-battery position (shown in FIG. 5) and a rearward position (shown in FIG. 7). The bolt assembly 22 includes a bolt 24, an extractor 26, a bolt knob 28, and a firing pin 64. A handguard 30 is secured to the forward end of the upper receiver 14 around the barrel 16 to protect the hand of a user from heat evolved from the barrel 16 upon firing of the gas-delayed blowback firearm 10. A magazine 32 received in the lower receiver 12 supplies cartridges (omitted for clarity) for loading by the bolt assembly 22 into the chamber 18.

A timing block 34 is secured to an upper portion of the bolt 24. In some embodiments, the timing block 34 can be secured to the bolt 24 using one or more threaded fasteners 33, such as screws, which are receivable through the timing block 34 in corresponding threaded recesses 35 formed in the upper portion of the bolt 24. In some embodiments, the timing block 34 can be secured to the bolt assembly 22 using alternative securing means, including but not limited to welds and pins, each alone or together with one or more threaded fasteners 33. Since a rearward force applied by the cartridge 19 against the bolt assembly 22 upon or shortly after discharge of a cartridge 19 received in the cartridge chamber 18 is what moves the bolt assembly 22 out of the forward in-battery position (see FIG. 5) and into the rearward position (see FIG. 7), the mass of the timing block 34 can be selected to affect the speed and timing of rearward travel of the bolt assembly 22 upon or shortly after discharge of cartridge 19.

A recess 36 is formed in a forward portion of the upper receiver 14 directly above the barrel 16. A forward surface 39 of a rear wall 40 defines the rear end 39 of the recess 36. The rear wall 40 partitions or separates the recess 36 from the bolt cavity 38. A portion of the bolt cavity 38 in which the timing block 34 reciprocates is disposed longitudinally rearward from the recess 36. The bolt assembly 22 and attached timing block 34 reciprocate back and forth in the bolt cavity 38 between the forward in-battery position (see FIG. 5) and the rearward position (see FIG. 7) during cycling of the firearm 10. An elongated passageway 41 extends through the rear wall 40 and operatively connects the recess 36 to the bolt cavity 38. A thin wall 43 defines a bottom surface of the recess 36 and separates the recess 36 from the barrel 16.

An elongated cylinder housing 42 is secured within the recess 36 of the upper receiver 14. The recess 36 is shaped and sized to receive and securely engage a portion of the cylinder housing 42. The cylinder housing 42 and the recess 36 can include complimentary screw threads such that the cylinder housing 42 is threadingly engaged with the recess 36 when the cylinder housing 42 is received in the recess 36. In some embodiments, the cylinder housing 42 can be secured in the recess 36 using one or more pins (not shown) extending through a portion of each of the upper receiver 14 and the cylinder housing 42. For increased securement, the cylinder housing 42 can be secured in the recess 36 using complimentary screw threads on the housing 42 and the recess 36, and one or more pins (not shown).

The cylinder housing 42 includes an internal gas chamber 44, a cylinder gas port 46 defined in the bottom of the cylinder housing 42, an open forward end 47, and a rear end 57 through which is defined a hole 55. The cylinder gas port 46 in fluid communication with the gas chamber 44. The gas chamber 44 extends axially through the cylinder housing 42 substantially parallel to the bore 20 of the barrel 16 when the barrel 16 is properly secured to the upper receiver 14 and the cylinder housing 42 is properly secured in the recess 36 of the receiver 14. When properly secured in the recess 36 as exemplified in FIGS. 5-7, the cylinder housing 42 is oriented such that the cylinder gas port 46 is directly above and coaxially aligned with the barrel gas port 21. In some embodiments, the cylinder gas port 46 can be substantially vertically aligned with the barrel gas port 21.

A gas passageway 48 extends through the thin wall 43 portion of the upper receiver 14 between the barrel gas port 21 and the cylinder gas port 46. The gas passageway 48 operatively links and fluidly communicates the barrel gas port 21 with the cylinder gas port 46 so that the bore 20 of the barrel 16 is in fluid communication with the gas chamber 44 through the gas passageway 48. When the barrel 16 is properly secured to the upper receiver 14 and the cylinder housing 42 is properly secured in the recess 36 of the receiver 14 as exemplified in FIGS. 5-7, the cylinder gas port 46, the gas passageway 48, and the barrel gas port 21 are all coaxially aligned. In some embodiments, each of the cylinder gas port 46, the gas passageway 48, and the barrel gas port 21 can be substantially vertically aligned. The phrase "substantially vertically aligned" as used herein means that the indicated ports 21, 46 and gas passageway 48 are sufficiently aligned in a vertical dimension that gas from the barrel bore 20 can flow through the indicated ports 21, 46 and gas passageway 48 into the gas chamber 44. It should be noted that, while the gas passageway 48 is depicted in the drawings as a hole defined through the thin wall 43 portion of the upper receiver 14, the gas passageway 48 in some embodiments can be a tube extending between gas ports 21, 46 regardless of whether an intervening portion of the upper receiver 14 exists between the ports.

A plunger 50 is received within the gas chamber 44 of the cylinder housing 42 through the open forward end 47. The plunger 50 includes an elongated rod portion 52 and a head portion 54. The rod portion 52 has a rod diameter $D_R$, while the head portion 54 has a head diameter $D_H$. The head diameter $D_H$ is greater than the rod diameter $D_R$. The head diameter $D_H$ can be equal to or slightly less than a diameter of the gas chamber 44. The head diameter $D_H$ is selected so the interior surface of the gas chamber 44 forms a tight seal around the plunger head 54. The rod portion 52 extends rearwardly out of the hole 55 in the rear end 57 of the cylinder housing 42 and through the elongated passageway 41 in the partition 40 into the bolt cavity 38. The rear end 53 of the rod portion 52 is received and secured in an aperture 37 formed in the timing block 34. In this way, the plunger 50 is secured to the bolt assembly 22. As such, the plunger 50 is configured to reciprocate backward and forward within the gas chamber 44 along an axis 51 of the cylinder housing 42 with the bolt assembly 22 when the bolt assembly 22 reciprocates backward and forward between the forward in-battery position (see FIG. 5) and the rearward position (see FIG. 7) during discharge and cycling of the firearm 10. In some embodiments, the rear end 53 of the rod 52 and the aperture 37 in the timing block 34 can include complimentary screw threads such that the rod 52 is threadingly engaged with the aperture 35 and thus the timing block 34. For increased securement, in some embodiments, the rod 52 can also be pinned or otherwise secured to timing block 34.

Figure 5:
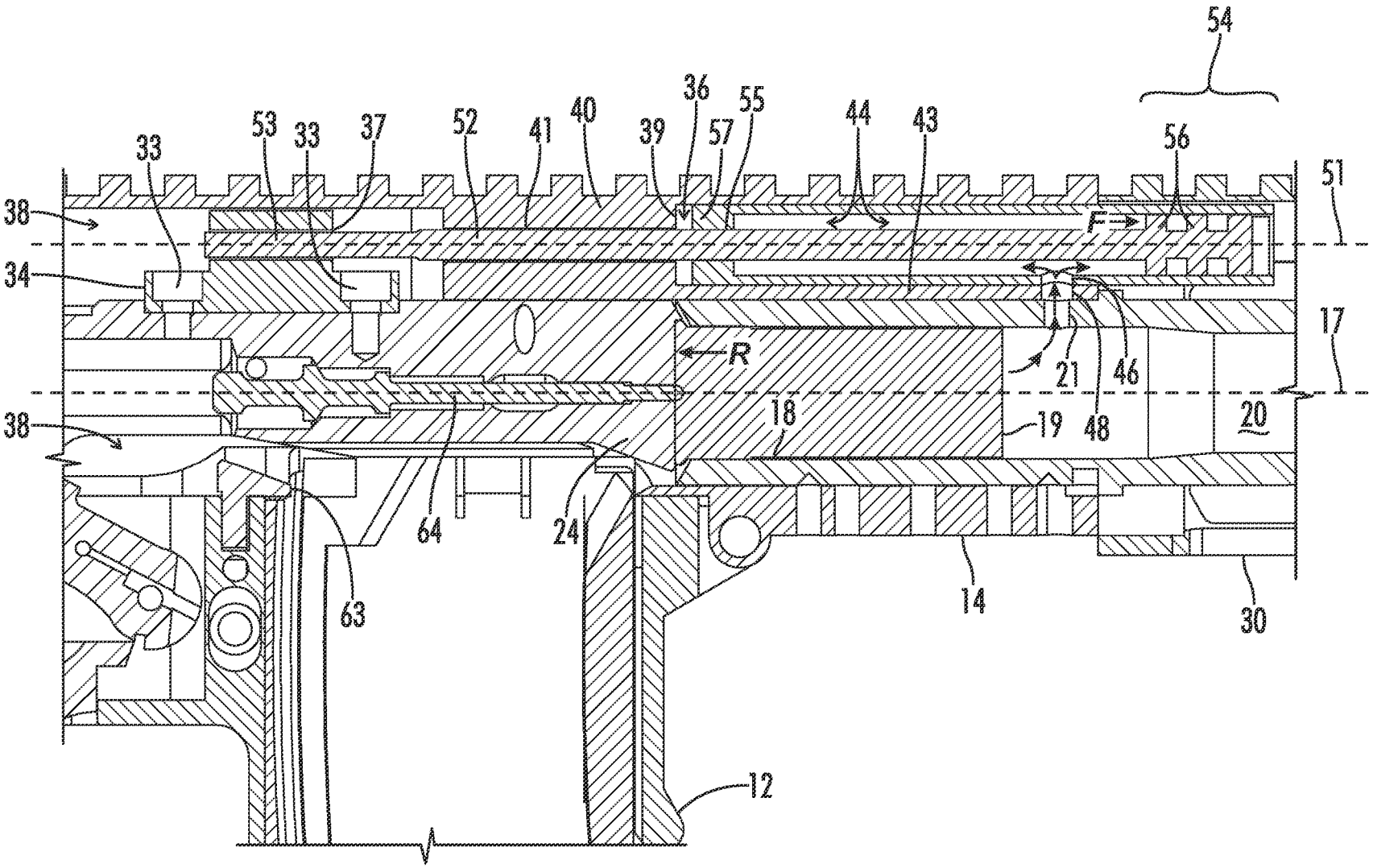
FIG. 5 is a magnified view of the firearm of FIG. 1 at location 5 of FIG. 4.
Figure 6:
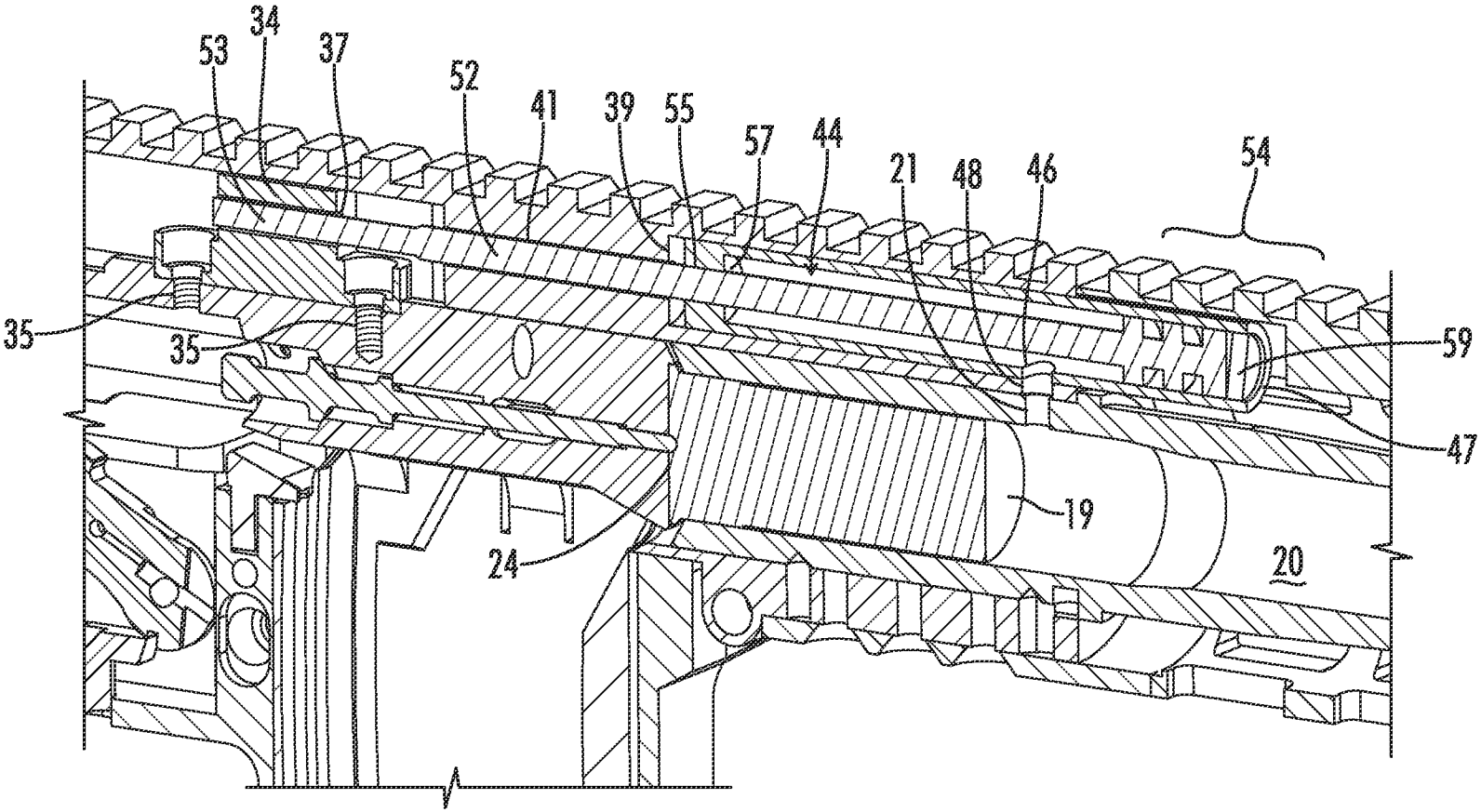
FIG. 6 is a magnified perspective view of the firearm of FIG. 1 at location 5 of FIG. 4.

The head portion 54 of the plunger 50 rests in the gas chamber 44 forward of the cylinder gas port 46 when the plunger 50 and attached bolt assembly 22 are in the forward in-battery position, as best shown in FIGS. 5-6. The plunger head 54 includes a plurality of radially extending spaced fins or baffles 56. The baffles 56 work like a piston to capture pressurized gasses from the barrel bore 20 generated upon discharge of a cartridge 19. The forward face of the plunger head 54 includes a notch 59. The notch 59 can be shaped and sized to receive a tool, such as a flat head screwdriver. This facilitates securement of the plunger 50 within the cylinder housing 42 by enabling a user to more easily rotate or thread the rod portion 52 into the aperture 37 of the timing block 34.

In use, a gas-delayed blowback AR-pattern firearm 10 of the present invention is advantageously operated in a manner that will be apparent to those of ordinary skill in the art familiar with AR-pattern firearms. Specifically, depressing the trigger 60 when a cartridge 19 is chambered and the firearm is charged (e.g., with the bolt assembly 22 in the forward in-battery position) causes the hammer 62 to strike the firing pin 64. The bolt catch 63 is forward of the hammer 62. The hammer 62 moves the firing pin 64 forward to strike a primer (not shown) located on the back of a cartridge 19 received in the chamber 18, which ignites the propellant charge contained in the cartridge 19. Ignition of the propellant in the cartridge 19 generates expanding (i.e., pressurized) gasses in the bore 20 and causes the cartridge casing (i.e., hull) to apply a rearward force against the face of the bolt 24. This simultaneously propels one or more projectiles contained in the cartridge 19 down the bore 20 of the barrel 16 and out the muzzle of the firearm 10 toward a target.

At least some of the pressurized gasses generated upon discharge of the cartridge 19 immediately pass from the bore 20 of the barrel 16 through the barrel gas port 21, the gas port passageway 48, the cylinder gas port 46, and into the gas chamber 44, as indicated by arrows in FIG. 5. This temporarily pressurizes the portion of the gas chamber 44 between the rear end 57 of the cylinder housing 42 and the baffles 56 on the plunger head 54. Pressurization of the gas chamber 44 when the plunger 50 is in the forward in-battery position applies a forward force to the plunger head 54. The forward force on the plunger head 54 is initially greater than the rearward force applied by the cartridge 19 against the bolt assembly 22 upon discharge. As such, the forward force causes the plunger 50 to delay rearward travel (i.e., rearward reciprocation) of the bolt assembly 22 because the rear end 53 of the plunger rod 52 is secured to the timing block 34 and the timing block 34 is secured to the bolt assembly 22. Thus, the forward force applied to the plunger head 54 holds the plunger rod 52 and the connected timing block 34 and bolt assembly 33 in the forward in-battery position for a brief predetermined period of time.

Figure 7:
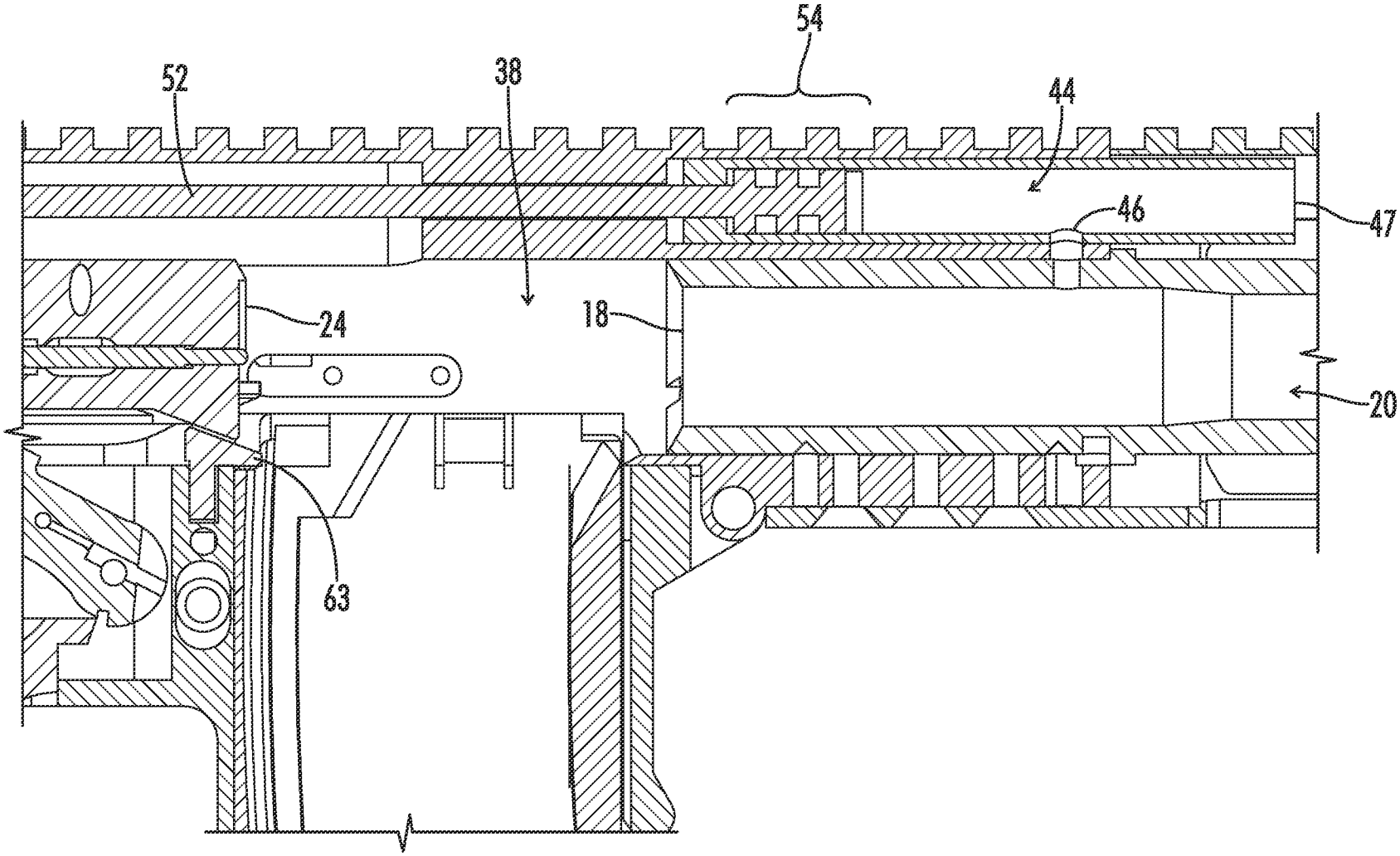
FIG. 7 is a magnified view of the firearm of FIG. 1 at location 5 of FIG. 4 showing the firearm in an out-of-battery configuration with the bolt assembly fully retracted in the rearward position.
Figure 8:
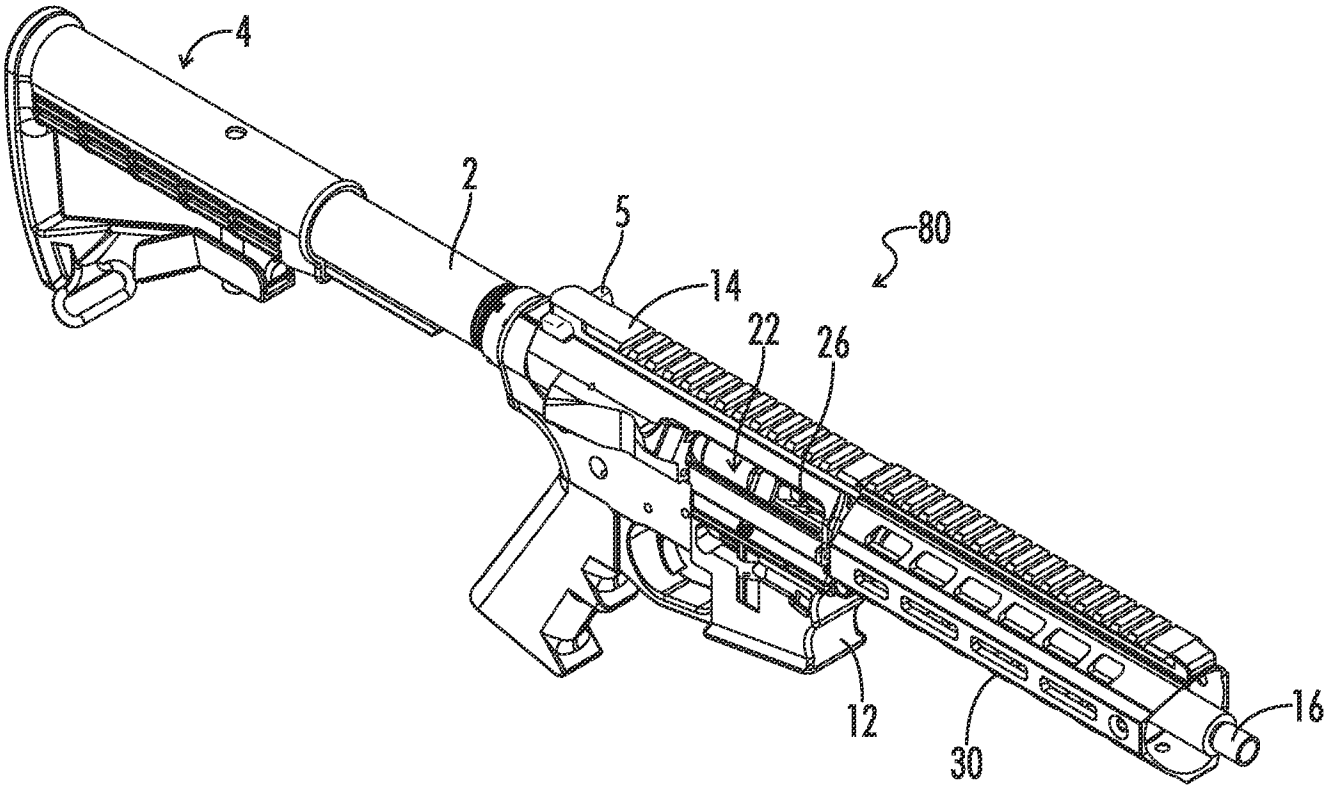
FIG. 8 is an elevated front perspective view of another embodiment of an AR-pattern firearm having a gas-delayed blowback operating system of the present invention showing the firearm in an in-battery configuration. The magazine is omitted for clarity.
Figure 9:
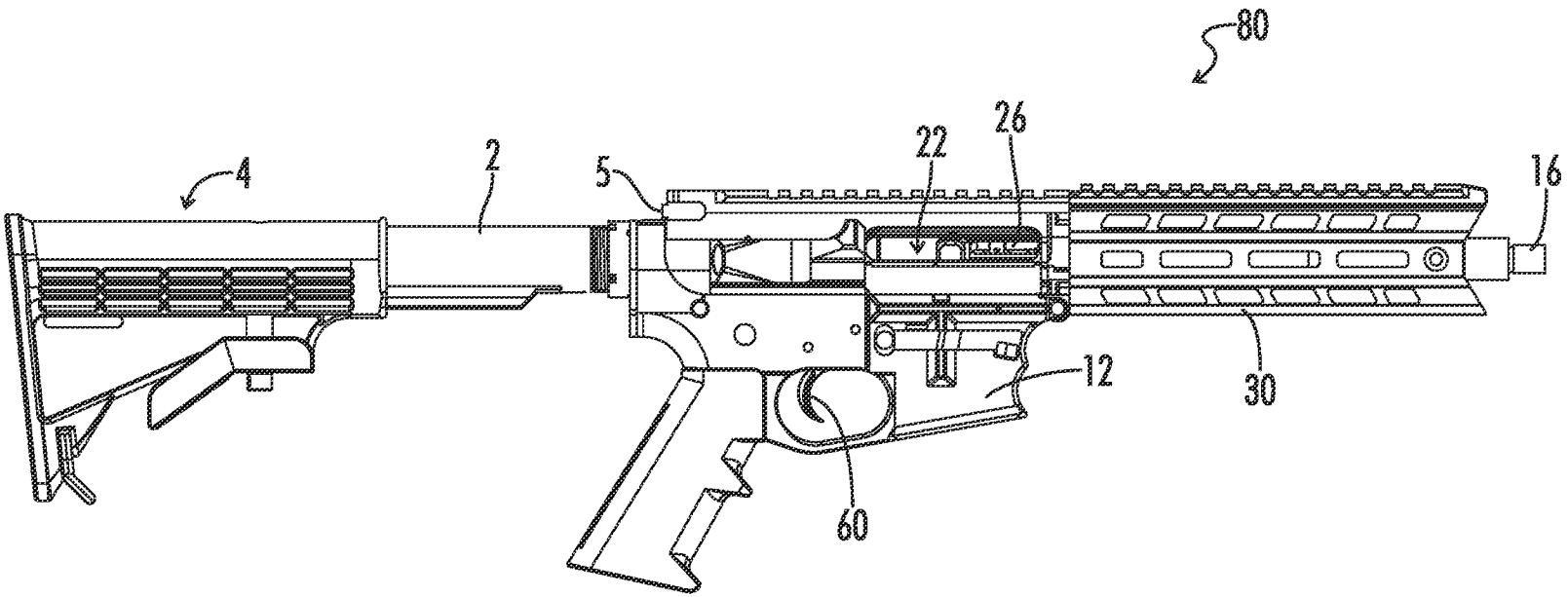
FIG. 9 is a right-side elevational view of the firearm of FIG. 8.
Figure 10:
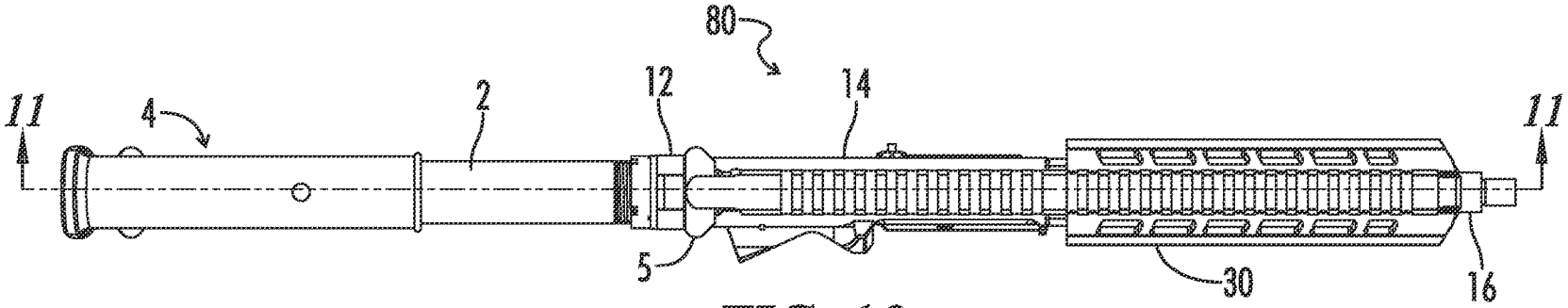
FIG. 10 is a top plan view of the firearm of FIG. 8.
Figure 11:
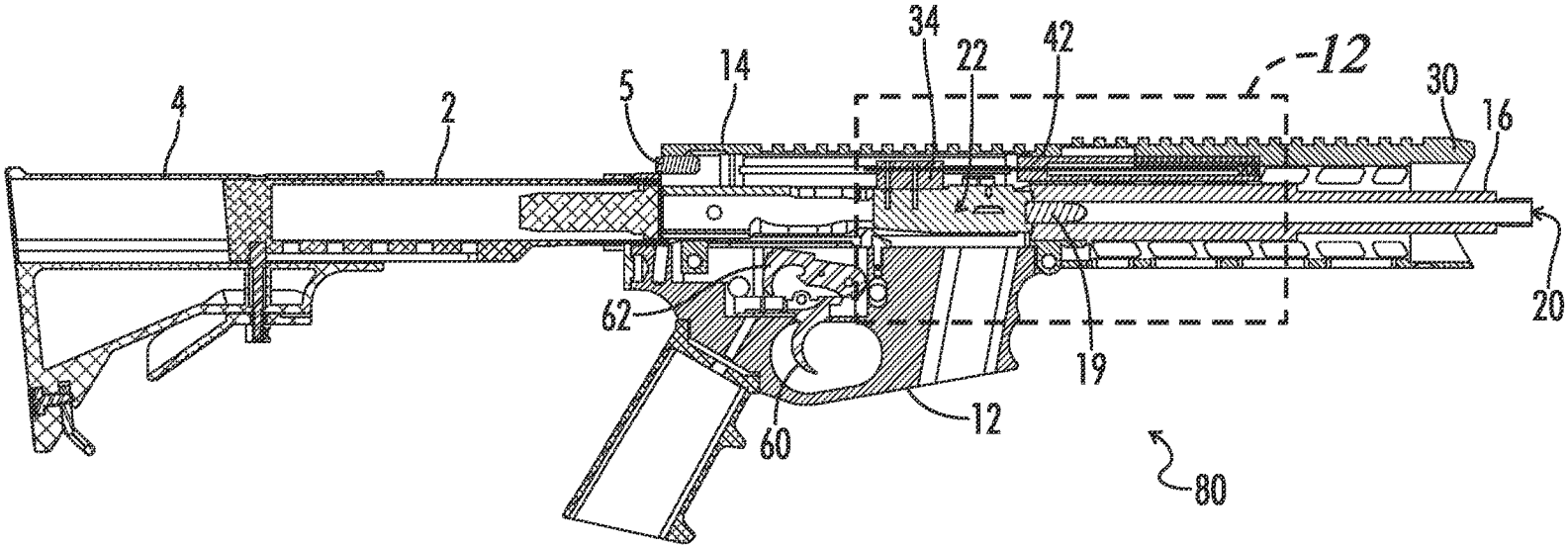
FIG. 11 is a sectional view of the firearm of FIG. 8 taken along line 11-11 of FIG. 10.
Figure 12:
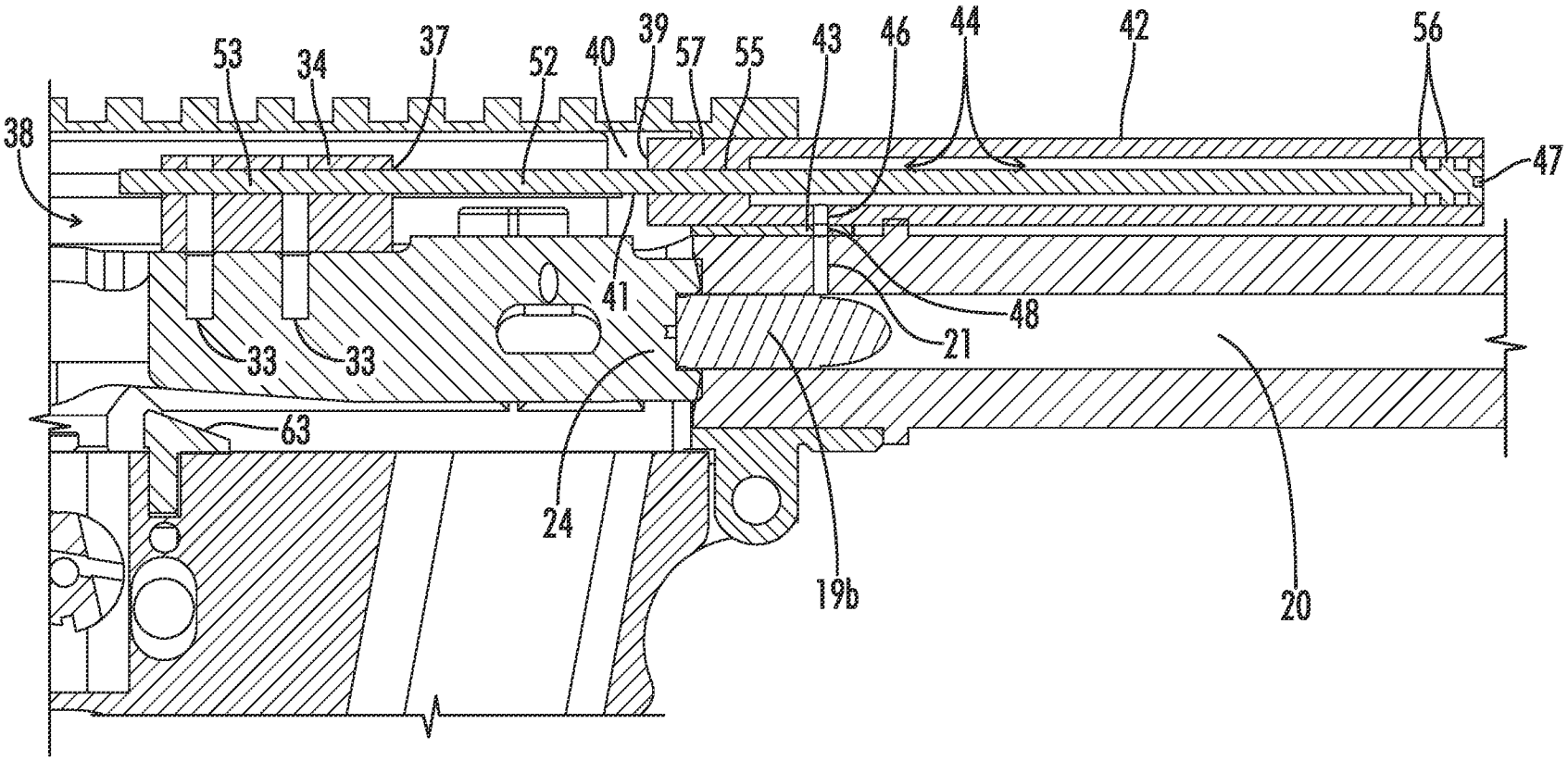
FIG. 12 is a magnified view of the firearm of FIG. 8 at location 12 of FIG. 11, showing the firearm with the handguard omitted for clarity.
Figure 13:
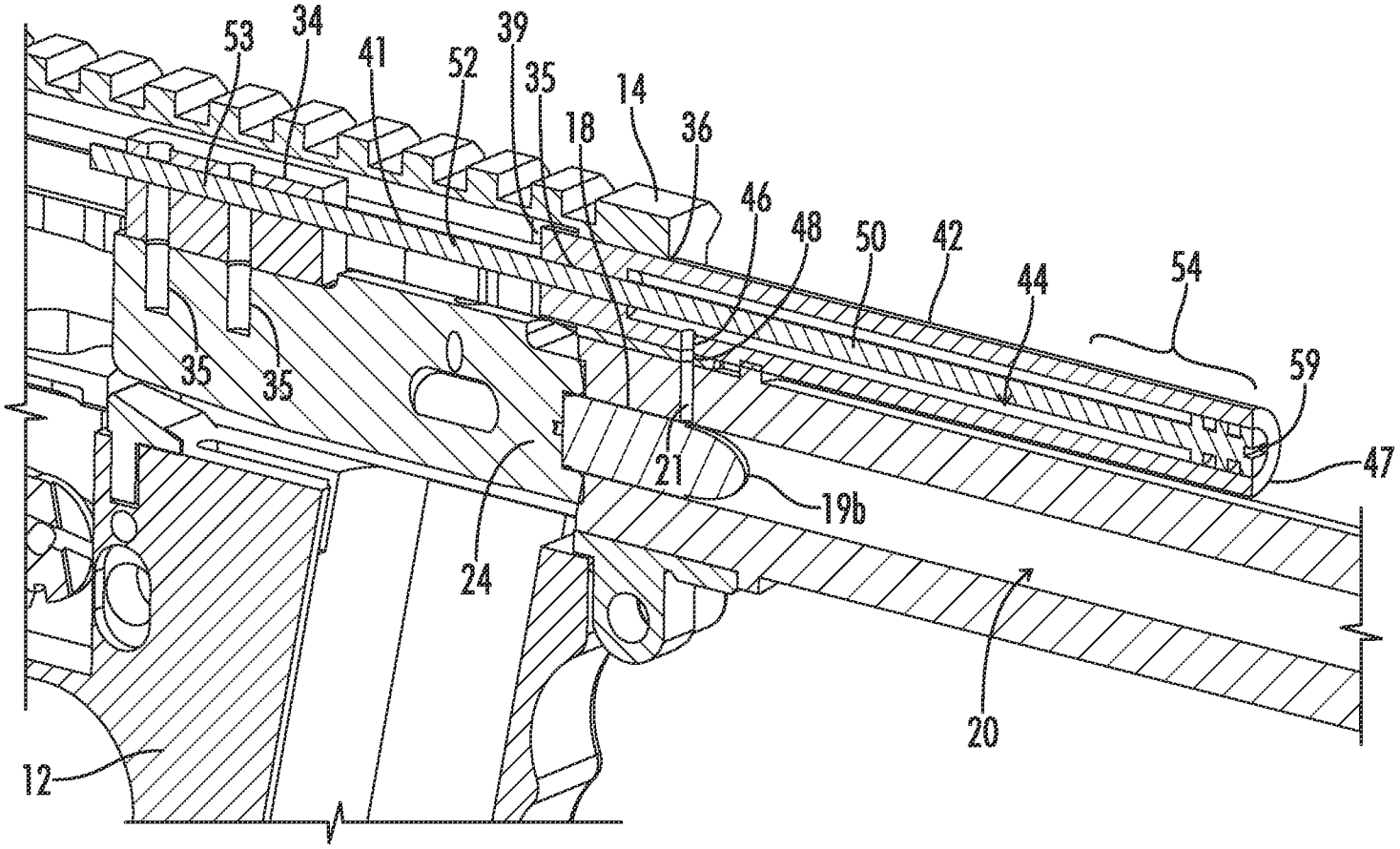
FIG. 13 is a magnified perspective view of the firearm of FIG. 8 at location 12 of FIG. 11, showing the firearm with the handguard omitted for clarity.
Figure 14:
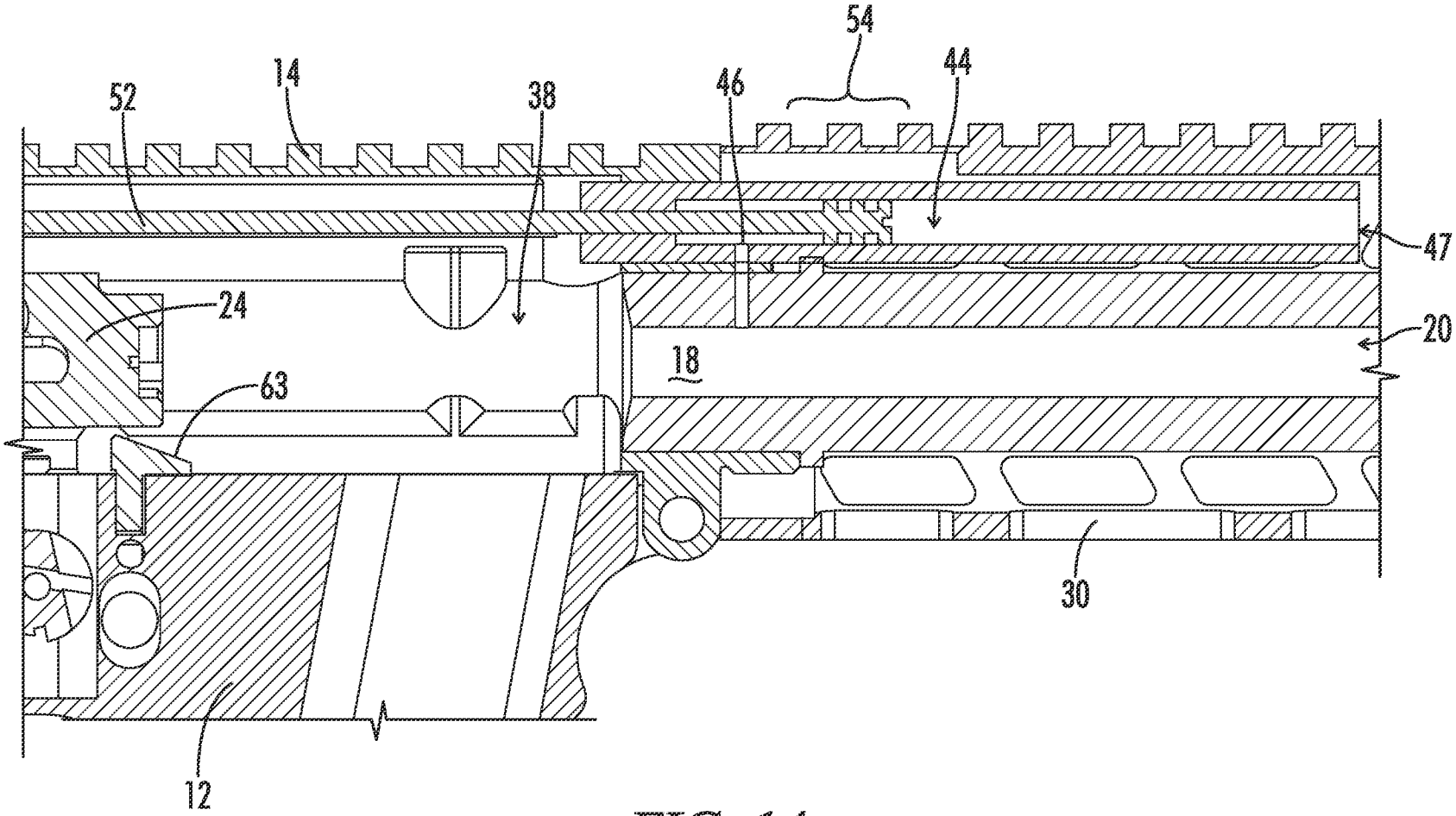
FIG. 14 is a magnified view of the firearm of FIG. 8 at location 12 of FIG. 11 showing the firearm in an out-of-battery configuration with the bolt assembly fully retracted in the rearward position.

The plunger 50 delays rearward travel of the bolt assembly 22 until the pressure in the gas chamber 44 decreases to a predetermined level whereby the rearward force applied by the cartridge 19 against the bolt assembly 22 overcomes the forward force applied to the plunger head 54 and moves the bolt assembly 22 toward the rearward position shown in FIG. 7. In some embodiments, the plunger 50 delays rearward travel of the bolt assembly 22 until the pressure in the gas chamber 44 decreases enough for the rearward force applied by the cartridge 19 against the bolt assembly 22 to overcome the forward force applied to the plunger head 54 and move the bolt assembly 22 toward the rearward position. In this way, the forward force applied to the plunger head 54 by the pressurized gasses maintains the bolt assembly 22 the forward in-battery position until the gas pressure drops sufficiently for extraction of the cartridge casing to be safe.

As noted above, rearward travel of the bolt assembly 22 is delayed for a brief predetermined period of time (e.g., milliseconds) until the one or more projectiles have neared or exited the muzzle of the barrel 16. Travel of the one or more projectiles down the bore 20 of the barrel 16 creates more space in the bore 20 for the pressurized gasses resident in the gas chamber 44 and bore 20 to fill. This allows the gasses inside the gas chamber 44 holding the plunger head 54 in the forward in-battery position to bleed back through the cylinder gas port 46, the gas passageway 48, the barrel gas port 21 and into the bore 20 of the barrel 16. This in turn causes the gas pressure in the gas chamber 44 to diminish or dissipate to the point where the rearward force applied by the cartridge casing to the bolt 24 upon discharge overcomes the forward force applied to the plunger head 54 by the pressurized gasses.

Once the forward pressure on the piston head 54 has sufficiently diminished, the rearward force applied to the bolt 24 by the cartridge casing will cause the bolt assembly 22 to move rearward and cycle the firearm 10. Because the rear end 53 of the rod 52 is secured to the timing block 34 and the timing block 34 is secured to the bolt assembly 22, rearward travel of the bolt assembly 22 also causes the plunger 50 and thus the plunger head 54 to move to the rearward position within the cylinder housing 42 (see FIG. 7). This in turn causes the plunger head 54 to push out some or all of the gas remaining in the gas chamber 44 through the cylinder gas port 46, the gas passageway 48, and the barrel gas port 21 back into the bore 20 of the barrel 16 where the gas can exhaust to the atmosphere once the one or more projectiles have exited the muzzle of the firearm 10.

FIGS. 8-14 depict another embodiment of an AR-pattern firearm with a gas-delayed blowback operating system 80 of the present invention. It should be understood that the embodiment depicted in FIGS. 8-14 is shown with certain components (e.g., a magazine) omitted in order to more clearly depict the operational components of the gas-delayed blowback operating system 10 disclosed herein. Any omitted components are readily identifiable to and well known by those of ordinary skill in the art. The gas-delayed blowback firearm 80 of FIGS. 8-14 is alike to the gas-delayed blowback firearm 10 of FIGS. 1-7 in all aspects of form and function except as subsequently specifically described or depicted in the drawings. For example, firearm 80 is depicted as being chambered for 9 mm cartridges 19*b*. As such, the various components of the firearm 80 are sized and shaped to receive and function with 9 mm cartridges instead of 12-gauge shotshells. Firearm 80 also includes a charging handle 5 instead of bolt knob 28. However, firearm 80 could readily be configured to function with a bolt knob 28 instead of charging handle 5.

The barrel gas port 21 of firearm 80 is defined through an upper portion of the barrel 16 directly adjacent to the chamber 18. This arrangement achieves near immediate pressurization of the gas chamber 44 upon discharge. It also aids in the capture of high pressure gasses to more effectively delay rearward travel of the bolt assembly 22 as the projectile travels down the bore 20. By contract, placement of the aligned gas ports 21, 46 and gas passageway 48 further down the bore 20 of the barrel 16 away from the chamber 18 and toward the muzzle of a firearm can decrease the pressure of gasses which enter the gas chamber by allowing the gasses to expand to fill more of the bore 20 as the projectile nears the muzzle. This in turn can prevent the gas chamber 44 from becoming sufficiently pressurized to delay rearward travel of the plunger 50 and attached bolt assembly 22.

An AR-pattern firearm having a gas-delayed blowback operating system 10 of the invention can be assembled by providing an AR-pattern lower receiver 12, an upper receiver 14, a barrel 16, a bolt assembly 22, a timing block 34, a cylinder housing 42, and a plunger 50. The barrel 16 is secured to the upper receiver 14 such that the barrel gas port 21 is aligned with the gas passageway 48. In some embodiments, the barrel 16 is secured to the upper receiver 14 such that the barrel gas port 21 is coaxially aligned with the gas passageway 48. The cylinder housing 42 is at least partially secured in the recess 36 such that the cylinder gas port 46 is aligned with the gas passageway 48. In some embodiments, the cylinder housing 42 is at least partially secured in the recess 36 such that the cylinder gas port 46 is coaxially aligned with the gas passageway 48. The timing block 34 is secured to the bolt 24. The bolt assembly 22 with timing block 34 secured thereto is arranged in the bolt cavity 38. The plunger 50 is inserted rod portion 52 first into the gas chamber 44 via the open forward end 47 of the cylinder housing 42. The plunger 50 is arranged in the gas chamber 44 such that the rod portion 52 extends rearwardly out of the hole 55 in the cylinder housing 42, through passageway 41, and into the bolt cavity 38 and timing block aperture 37 where the rear end 53 of the rod 52 is secured to form an upper receiver assembly. The upper receiver assembly is then coupled to the lower receiver 12 to form the gas-delayed blowback firearm 10.

In all embodiments disclosed herein, the speed with which the bolt assembly 22 cycles can be controlled by varying the mass of the timing block 34. For example, use a larger or heavier timing block 34 will slow the cycle rate, whereas use of a smaller or lighter timing block 34 will increase the cycle rate.

The gas-delayed blowback operating system 10 for AR-platform firearms disclosed herein advantageously prevents premature and unsafe extraction of the cartridge casing by delaying extraction until gas pressure in the system drops to safe levels. It also eliminates the need of traditional AR-pattern firearms for a rotating bolt, and thus likewise eliminates the need for locking lugs on the bolt 24. Eliminating the use of a rotating and locking bolt translates to fewer parts required to cycle the firearm, which simplifies firearm operation and provides appreciable weight and cost savings.

Although embodiments of the present invention have been described in detail, it will be understood by those skilled in the art that various modifications can be made therein without departing from the spirit and scope of the invention as set forth in the appended claims. For example, AR-pattern firearms chambered for other relatively low-pressure cartridges, including but not limited to 0.22, 0.38, 0.380, 0.40, and .45 calibers, 0.410 gauge, and 20-gauge, which also include the gas-delayed blowback operating system disclosed herein are within the scope of the present invention and are covered by the claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A gas-delayed blowback firearm, comprising:

a lower receiver;

an upper receiver releasably coupled to the lower receiver;

a barrel secured to the upper receiver, the barrel having a cartridge chamber, an axial bore, and a barrel gas port in fluid communication with the bore;

a bolt assembly configured to reciprocate in the upper receiver between a forward in-battery position and a rearward position;

a timing block on the bolt assembly;

a cylinder housing secured in a recess defined in a forward portion of the upper receiver above the barrel, the cylinder housing having an internal gas chamber and a cylinder gas port in fluid communication with the gas chamber;

a gas passageway fluidly communicating the barrel gas port with the cylinder gas port; and a plunger in the gas chamber secured to the timing block such that the plunger reciprocates with the bolt assembly;

wherein discharge of a cartridge received in the cartridge chamber temporarily pressurizes the gas chamber, applying a forward force to the plunger which causes the plunger to delay rearward travel of the bolt assembly.

2. The firearm of claim 1, wherein the plunger delays rearward travel of the bolt assembly until the pressure in the gas chamber decreases to a predetermined level whereby a rearward force applied by the cartridge against the bolt assembly overcomes the forward force applied to the plunger and moves the bolt assembly toward the rearward position.

3. The firearm of claim 1, wherein the plunger includes a first end secured to the timing block and a second end which rests in the gas chamber forward of the cylinder gas port when the bolt assembly is in the forward in-battery position.

4. The firearm of claim 3, wherein:

the cylinder housing includes a rear end having a hole defined therethrough;

the first end of the plunger extends rearwardly out of the hole in the rear end of the cylinder housing; and the second end of the plunger includes a plurality of baffles.

5. The firearm of claim 1, wherein the gas chamber extends axially through the cylinder housing substantially parallel to the bore of the barrel.

6. The firearm of claim 1, wherein:

the plunger includes a rod portion and a head portion;

the rod portion has a rod diameter;

the head portion has a head diameter;

the head diameter is greater than the rod diameter;

the head portion rests in the gas chamber forward of the cylinder gas port when the bolt assembly is in the forward in-battery position;

the rod portion extends rearwardly from the head portion out of a rear end of the cylinder housing; and an end of the rod portion opposite the head portion is secured to the timing block.

7. The firearm of claim 1, wherein the barrel gas port is disposed forward of and adjacent or proximate to the cartridge chamber.

8. The firearm of claim 7, wherein the barrel gas port, the gas passageway, and the cylinder gas port are substantially vertically aligned.

9. The firearm of claim 7, wherein the gas passageway is defined through the upper receiver between the barrel gas port and the cylinder gas port.

10. A gas-delayed blowback firearm, comprising:

an AR-pattern lower receiver;

an upper receiver releasably couplable to the lower receiver;

a barrel attachable to the upper receiver, the barrel having a cartridge chamber, an axial bore, and a barrel gas port in fluid communication with the bore;

a bolt assembly receivable in the upper receiver and configured to reciprocate therein between a forward in-battery position and a rearward position;

a timing block attachable to the bolt assembly;

a cylinder housing attachable to the upper receiver, the cylinder housing having an internal gas chamber and a cylinder gas port in fluid communication with the gas chamber a recess defined in a forward portion of the upper receiver, the recess configured to receive at least a portion of the cylinder housing when the cylinder housing is attached to the upper receiver;

a gas passageway defined through the upper receiver which fluidly communicates the barrel gas port with the cylinder gas port when the barrel and the cylinder housing are attached to the upper receiver; and a plunger receivable in the gas chamber and attachable to the timing block such that the plunger reciprocates with the bolt assembly when the plunger is attached to the timing block and the timing block is attached to the bolt assembly;

wherein discharge of a cartridge received in the cartridge chamber temporarily pressurizes the gas chamber, applying a forward force to the plunger which causes the plunger to delay rearward travel of the bolt assembly until the pressure in the gas chamber decreases enough for a rearward force applied by the cartridge against the bolt assembly to overcome the forward force applied to the plunger and move the bolt assembly toward the rearward position.

11. The firearm of claim 10, wherein:

the cylinder housing includes a rear end having a hole defined therethrough;

the plunger includes a rod portion which extends rearwardly out the hole in the cylinder housing, and a head portion which rests in the gas chamber forward of the cylinder gas port when the cylinder housing is attached to the upper receiver, the plunger is received in the cylinder housing, the timing block is attached to the bolt assembly, the rod portion of the plunger is attached to the timing block, and the bolt assembly is in the forward in-battery position.

12. The firearm of claim 11, wherein:

the rod portion has a rod diameter;

the head portion has a head diameter;

the head diameter is greater than the rod diameter; and the head portion includes a plurality of baffles.

13. The firearm of claim 10, wherein the gas chamber extends axially through the cylinder housing substantially parallel to the bore of the barrel when the barrel and the cylinder housing are attached to the upper receiver.

14. A method of assembling the firearm of claim 10, comprising:

providing the upper receiver, the barrel, the bolt assembly, the timing block, the cylinder housing, and the plunger;

attaching the barrel to the upper receiver such that the barrel gas port is aligned with the gas passageway;

securing the cylinder housing in the recess of the upper receiver such that the cylinder gas port is aligned with the gas passageway;

attaching the timing block to the bolt assembly;

arranging the bolt assembly and attached timing block in the upper receiver;

inserting the plunger in the gas chamber of the cylinder housing; and attaching the plunger to the timing block.

15. An upper receiver assembly for a gas-delayed blowback firearm, comprising:

an upper receiver releasably couplable to an AR-pattern lower receiver;

a barrel attachable to the upper receiver, the barrel having a cartridge chamber, an axial bore, and a barrel gas port in fluid communication with the bore;

a bolt assembly receivable in the upper receiver and configured to reciprocate therein between a forward in-battery position and a rearward position;

a timing block attachable to the bolt assembly;

a cylinder housing attachable to the upper receiver, the cylinder housing having an internal gas chamber and a cylinder gas port in fluid communication with the gas chamber;

a recess defined in a forward portion of the upper receiver, the recess configured to receive at least a portion of the cylinder housing when the cylinder housing is attached to the upper receiver;

a gas passageway defined through the upper receiver which fluidly communicates the barrel gas port with the cylinder gas port when the barrel and the cylinder housing are attached to the upper receiver; and a plunger receivable in the gas chamber and attachable to the timing block such that the plunger reciprocates with the bolt assembly when the plunger is attached to the timing block and the timing block is attached to the bolt assembly;

wherein discharge of a cartridge received in the cartridge chamber temporarily pressurizes the gas chamber, applying a forward force to the plunger which causes the plunger to delay rearward travel of the bolt assembly until the pressure in the gas chamber decreases such that a rearward force applied by the cartridge against the bolt assembly overcomes the forward force applied to the plunger and moves the bolt assembly toward the rearward position.

16. The upper receiver assembly of claim 15, wherein the cylinder housing includes:

an open forward end through which the plunger is receivable, and a rear end in which is formed a hole through which a portion of the plunger extends when the plunger is attached to the timing block.

17. The upper receiver assembly of claim 15, wherein the plunger includes a first end configured to be engaged with the timing block and a second end which rests in the gas chamber forward of the cylinder gas port when the cylinder housing is attached to the upper receiver, the plunger is received in the cylinder housing, the timing block is attached to the bolt assembly, the first end of the plunger is engaged with the timing block, and the bolt assembly is in the forward in-battery position.

18. A gas-delayed blowback firearm, comprising an upper receiver assembly of claim 15 coupled to the lower receiver.

19. A method of assembling a gas-delayed blowback firearm, comprising:

providing the lower receiver and an upper receiver assembly of claim 15;

attaching the barrel to the upper receiver such that the barrel gas port is aligned with the gas passageway;

attaching the cylinder housing in the recess of the upper receiver such that the cylinder gas port is aligned with the gas passageway;

attaching the timing block to the bolt assembly;

arranging the bolt assembly and attached timing block in the upper receiver;

inserting the plunger in the gas chamber of the cylinder housing; and attaching the plunger to the timing block; and coupling the upper receiver assembly to the lower receiver.

* * * * *